United States Patent [19]

Bakermans et al.

[11] Patent Number: 4,497,196

[45] Date of Patent: Feb. 5, 1985

[54] APPARATUS FOR PERFORMING OPERATIONS ON STRIP MATERIAL

[75] Inventors: Johannes C. W. Bakermans, Harrisburg, Pa.; Dimitry G. Grabbe, Lisbon Falls, Me.

[73] Assignee: AMP Incorporated, Harrisburg, Pa.

[21] Appl. No.: 464,439

[22] Filed: Feb. 7, 1983

[51] Int. Cl.[3] ..... B21J 71/00; B21J 9/18

[52] U.S. Cl. ..... 72/405; 72/450; 72/452; 83/602; 83/628; 74/54

[58] Field of Search ..... 72/405, 404, 452, 450, 72/455, 315, 338, 339; 83/628, 602, 513; 74/54, 570

[56] References Cited

U.S. PATENT DOCUMENTS

| | | | |
|---|---|---|---|
| 20,516 | 6/1858 | Sherman | 83/628 |
| 2,389,139 | 11/1945 | Crane et al. | 72/315 |
| 2,695,061 | 11/1954 | Laxo | 83/513 |
| 2,726,702 | 12/1955 | Laxo | 72/315 |
| 3,277,690 | 10/1966 | Kraujalis | 72/452 |
| 3,802,247 | 4/1974 | Karsnak | 72/405 |
| 3,807,215 | 4/1974 | Olsen et al. | 72/405 |

FOREIGN PATENT DOCUMENTS

| | | | |
|---|---|---|---|
| 365876 | 1/1973 | U.S.S.R. | 72/405 |
| 567559 | 8/1977 | U.S.S.R. | 72/315 |

*Primary Examiner*—Daniel C. Crane
*Attorney, Agent, or Firm*—F. W. Raring

[57] ABSTRACT

Machine for performing operations on strip material comprises a plurality of modules on a supporting bed. Each module has a strip feeder, a tooling assembly, and an actuating assembly. Strip is fed through the modules by the feeder and in each module the tooling assembly performs an operation such as stamping, forming, marking, etc. The modules feed the strip in a vertical plane and the modules are symmetrical with respect to the vertical plane of the strip. Preferably the actuating assembly and the tooling assembly is dynamically balanced. Advantages achieved include high speeds, reduced power requirements, reduced noise, and reduced tooling cost.

11 Claims, 14 Drawing Figures

66
22
24
37
90
92
20
8
164
162
172
26
160
14
86
172
168
178
160
30
28
18
162
18
10

APPARATUS FOR PERFORMING OPERATIONS ON STRIP MATERIAL

FIELD OF THE INVENTION

This invention relates to a machine for performing operations on strip material which is intermittently fed through the machine. The disclosed embodiment is in form of a stamping and forming machine for producing electrical terminals or the like.

The disclosed embodiment incorporates strip feeders of the type shown in application Ser. No. 444,291 filed Nov. 24, 1982, which application is hereby incorporated by reference. A machine in accordance with the invention can, however, be used with other types of strip feeders.

BACKGROUND OF THE INVENTION

Strip metal stamping and forming operations are widely used to produce articles such as fasteners or electrical terminals in continuous strip form. The commonly known type of forming apparatus comprises a press having a C-shaped frame member and a progressive die assembly mounted in the press. The die assembly has upper and lower die shoes, the upper shoe being reciprocated towards the lower shoe by a ram in the upper arm of the press which in turn is continuously reciprocated by a crank or eccentric. A feeding mechanism intermittently feeds the strip material through the press and between the upper and lower die shoes which contain a plurality of individual die stations. Each station will contain complementary upper and lower tooling for carrying out the operations which are performed on the material as it is fed through the die assembly, for example, a blanking or profiling operation which may be followed by several punching and forming operations during which individual articles are formed from the strip.

Stamping presses as described above are widely used and have been used ever since continuous stamping became an efficient manufacturing process. The equipment presently used for such operations has been satisfactory in the past and is highly reliable, however, presently used equipment has many shortcomings and disadvantages which must be contended with in present day strip manufacturing operations. For example, many of the parts made by stamping such as electrical terminals or fasteners are quite small and are produced from strip material having a thickness of 0.015 inches or less. However, the presses used for the forming operations are relatively massive and would appear to be greatly oversized relative to the scale of the operations being carried out. In fact, relatively massive presses and die shoe assemblies are required because the loading of the parts of the press is eccentric or non-symmetrical and the parts, such as the frame casting, must be enlarged so that they will be able to withstand the eccentric loading during millions of cycles of operation.

Because of the relatively high masses of the parts, presses now used for stamping and forming operations produce a very high level of noise in the work place and increasingly, it is becoming necessary to take steps to reduce the level of noise for reasons of the health of the workers.

The stroke of most presses used for high speed stamping and forming operations is extremely long relative to the nature of the operations being performed on the strip material; in other words, the stroke of the press will frequently have many times the maximum lateral dimension of the part being produced. As a result of the fact that the stroke is unduly long, the inertia developed during ech cycle is relatively high and the linear speed of the press ram is very high, particularly if the press is operated at a high speed, say 500 strokes per minute. These factors result in unduly high power requirements for the press and in the imposition of unduly high stresses in the tooling and other parts which are subject to wear. As a result, the maintenance costs for the tooling are increased, particularly if the press is being used to produce precisely dimensioned parts such as electrical terminals.

The present invention is directed to the achievement of an improved machine for performing stamping and forming, or similar, operations on strip material which will overcome the shortcomings of existing stamping presses. The invention is thus directed to the achievement of a machine which has greatly reduced power requirements, which will be extremely quiet as compared with existing stamping and forming machines, which can be operated at extremely high speeds without accompanying excessive wear of the press parts or the forming tooling and which can be "set up" or modified for different parts in a minimum amount of time. The invention is further directed to the achievement of a machine which does not require a conventional progressive die assembly but which is nonetheless capable of carrying out all of the stamping and forming operations which are now carried out by means of progressive dies.

One embodiment of the invention comprises a machine module for performing operations on strip material of the type comprising a strip feeder for intermittently feeding the material in a vertical plane along a strip feed path, an operating zone on the strip feed path, and first and second opposed tool holders in the operating zone. The tool holders are on opposite sides of the strip feed path and are reciprocable between retracted positions, in which the tool holders are relatively remote from the strip feed path, and closed positions, in which the tool holders are proximate to the strip feed path. The machine has actuating means for actuating the strip feeder and for reciprocating the tool holders in timed sequence with actuation of the strip feeder so that the tool holders arrive at, and depart from, their closed positions during dwell of the strip. The machine is characterized in that the actuating means comprises a continuously rotatable power shaft, first and second actuator levers, and first and second connecting links. The power shaft extends parallel to, and is spaced from, the strip feed path in the operating zone. The strip feed path and the vertical diametral plane of the power shaft lie in a common plane. The first and second actuator levers are on opposite sides of the common plane, the actuator levers being pivoted on first and second pivotal axes which extend parallel to the axis of the power shaft. The first and second connecting links are pivotally connected at one end to the first and second actuator levers and are eccentrically coupled at the other end to the power shaft. Coupling means are provided for coupling the first and second actuator levers to the tool holders. During continuous rotation of the power shaft, the actuator levers are oscillated by the connecting links and the tool holders are reciprocated by the actuator levers.

In accordance with a further embodiment, the strip feeder is located between the strip feed path and the power shaft, the first and second actuator levers are co-planar, and the first and second actuator levers and the first and second connecting links are symmetrical with respect to the common plane. The first and second actuator levers are substantially identical in mass and moment of inertia, the first and second connectng links are substantially identical in mass and moment of inertia, and the strokes of the first and second tool holders are the same whereby the machine is balanced with respect to the common plane.

In accordance with a further embodiment, a plurality of modules as described above are mounted on a machine bed and the strip material is fed through the modules and an operation is performed on the strip in each module. The modules are preferably adjustably mounted on the machine bed so that any lengthening of the strip which may take place as a result of the operations performed can be accommodated.

DESCRIPTION OF THE DRAWINGS

FIG. 1 shows a machine 2 in accordance with the invention for performing operations on strip material 4 which is drawn from a reel 6. During passage through the machine, stamping and forming operations, or other operations, are performed on the strip and the processed strip 4' is wound onto a take-up reel 6'. During feeding of the strip, notches 5 are produced in the lower edge 7 thereof as shown in FIG. 5 and as will be explained below. The strip will otherwise be modified in accordance with the type of operations carried out; for example, side-by-side contact terminals may be formed from the strip as it passes through the machine.

The machine comprises a plurality of individual machine modules 8 which are mounted on a machine bed 10. The modules may be identical to each other, excepting for the individual tools which are mounted therein so that a description of one will suffice for all.

Figure 2:
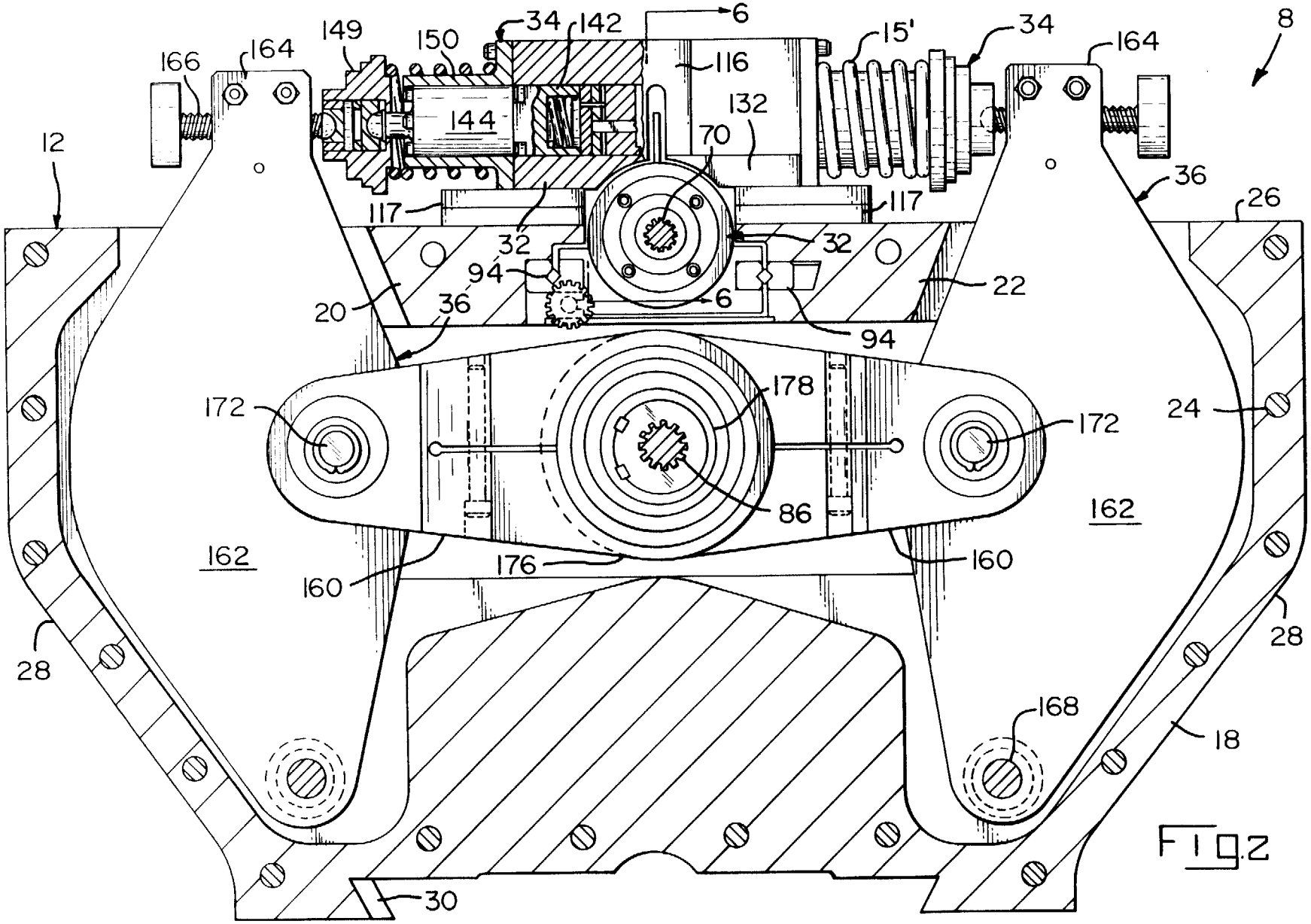
FIG. 2 is a cross section taken along the lines 2—2 of FIG. 1.
Figure 3:
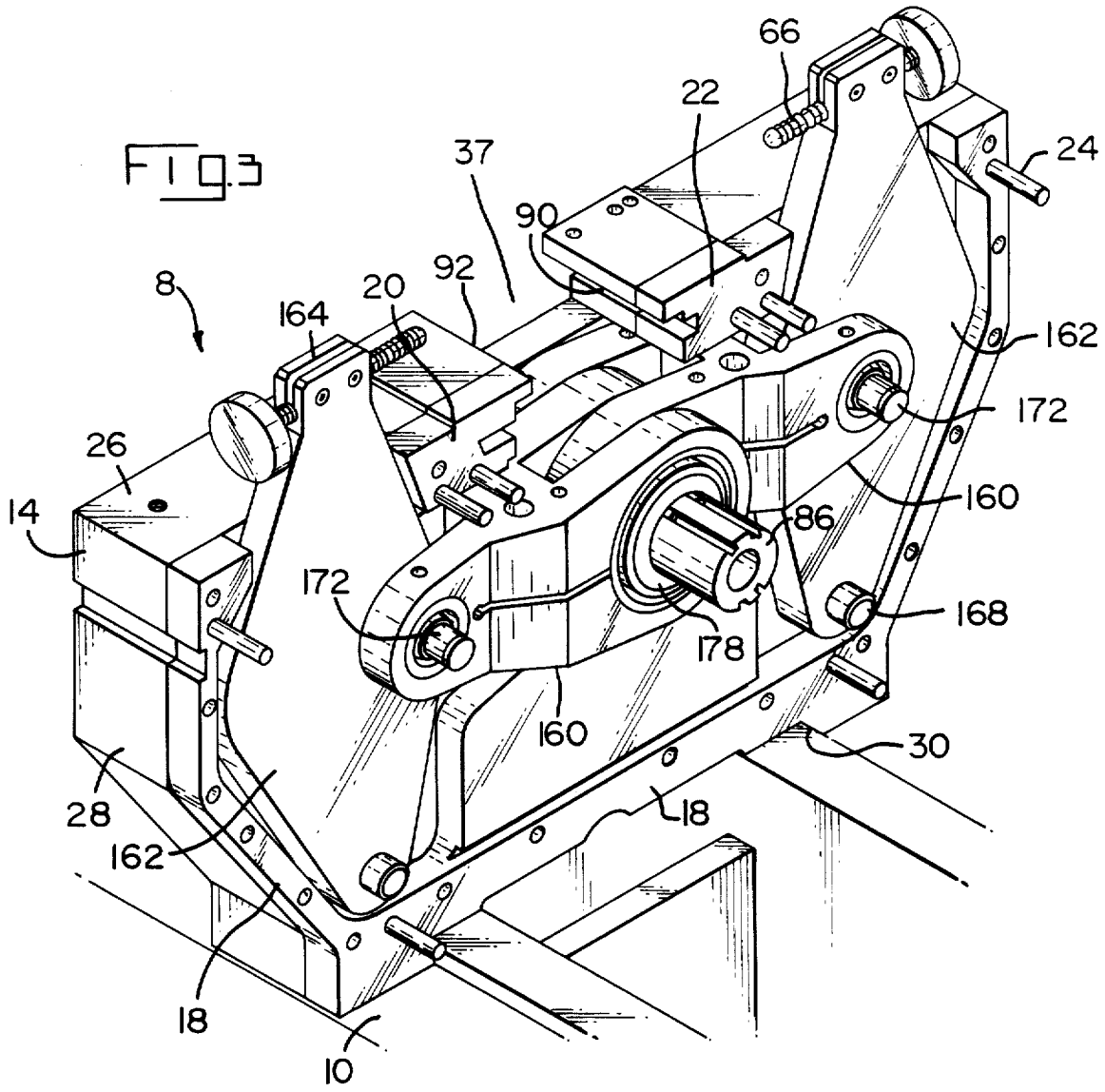
FIG. 3 is a perspective view showing one of the machine modules with one of the housing sections removed to reveal the actuating assembly contained in the housing.

Each module 8 comprises a housing assembly 12 composed of two housing parts or sections 14, 16 which are separated by a lower spacer 18 and a pair of upper spacers 20, 22, see FIGS. 2 and 3. The housing sections 14, 16 are secured to each other by suitable fasteners and are precisely positioned by aligning pins as shown at 24. The housing assembly has an upper surface 26, and laterally facing side surfaces 28, and a base 30 which has dove tails by means of which it is slidably mounted on the machine base 10.

Each module contains a strip feeder assembly 32, tool holder assemblies 34, on each side of the strip feed path, and actuator assemblies 36 on each side of the strip feed path. In the description which follows, the strip feeder assembly 32 will first be described and a tooling assembly will thereafter be described. As noted above, the strip feeder is disclosed and claimed in application Ser. No. 444, 291. Alternative types of strip feeders might be used in modules as described below.

The strip feeder is contained in a recess 37 (FIG. 3) in the upper surface 26 of the module housing and comprises a pair of spaced apart feed screws 38, 40, see FIGS. 6–10. Each feed screw has a cylindrical surface 42 having a feeding thread 44 thereon which extends from one end 43 of the feed screw to the other end 45. The feeding thread, FIG. 8, has a plurality of turns on the surface 42 and each turn has a feeding portion 46 and a dwell portion 48. The feeding portion 46 of each turn extends helically with respect to the axis of rotation while the individual dwell portions 48 define planes which extend normally of the axis of rotation. The feeding portion 46 ideally has an acceleration portion and a deceleration portion at its ends so that the strip will be accelerated at the beginning of each feeding cycle and decelerated at the end of the feeding cycle. The dwell portion 48 of each turn is enlarged as shown at 50 at its beginning for purposes of precisely positioning the strip with respect to the tooling assembly as explained fully in the above-identified application Ser. No. 444,291.

Figure 7:
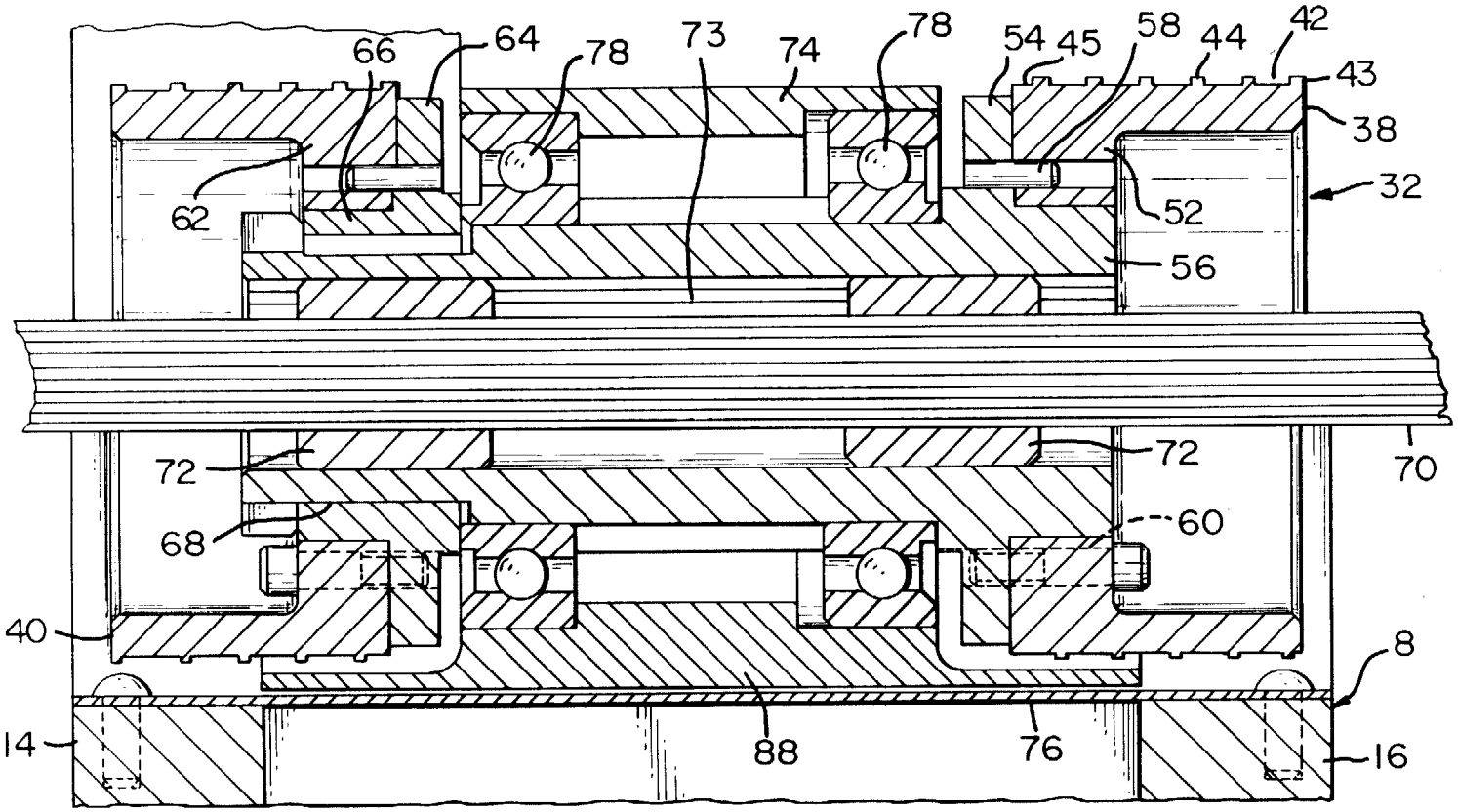
FIG. 7 is a view similar to FIG. 6 but showing the strip feeder in cross section.
Figure 8:
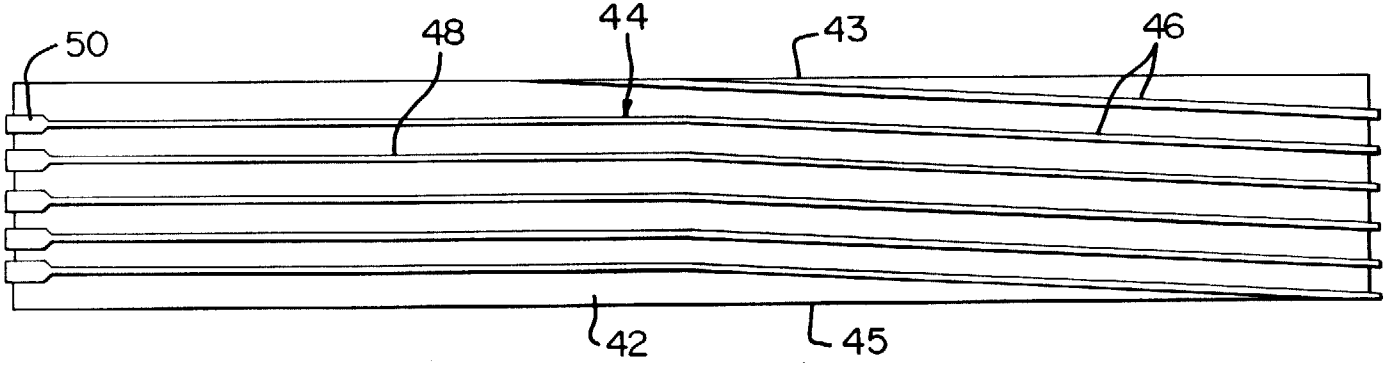
FIG. 8 is a view showing the cylindrical surface of one of the feed screws developed as a flat surface.

As shown in FIG. 7, the feed screw 38 has an inwardly directed flange 52 which is against the outwardly directed flange 54 on a hollow sleeve 56 which surrounds the continuously rotatable feed shaft 70. Feed screw 38 is precisely positioned on the sleeve 56 by means of aligning pins 58 and secured in position by fasteners 60. The feed screw 40 has an inwardly directed flange 62 which is similarly positioned against a flange 64 on an adaptor 66 which is secured on a reduced diameter end 68 of the sleeve 56. Aligning pins and fasteners locate screw 40 and secure it to the flange as previously explained. The feed screws must be precisely located relative to each other in a rotational sense so that the threads on both of the feed screws will enter the notches 5 in the strip 4.

The feed shaft 70 is splined and the interior of the sleeve 56 has splines as shown at 73. The sleeve 56 is secured to the shaft 70 by bushings 72 which are externally and internally splined. The entire strip feeder can thus be moved axially along the shaft 70 when adjustment is necessary.

Sleeve 56 extends through a bearing support assembly 74 which is disposed in the previously identified recess 37 and which has a base 88 that is above a cover plate 76 that extends between the housing sections 14, 16. Ball bearings 78 and raceways are provided between the surface of the sleeve 56 and the interior of the bearing support 74 so that the sleeve and the feed screws 38, 40 will rotate with the shaft 70.

Figure 1:
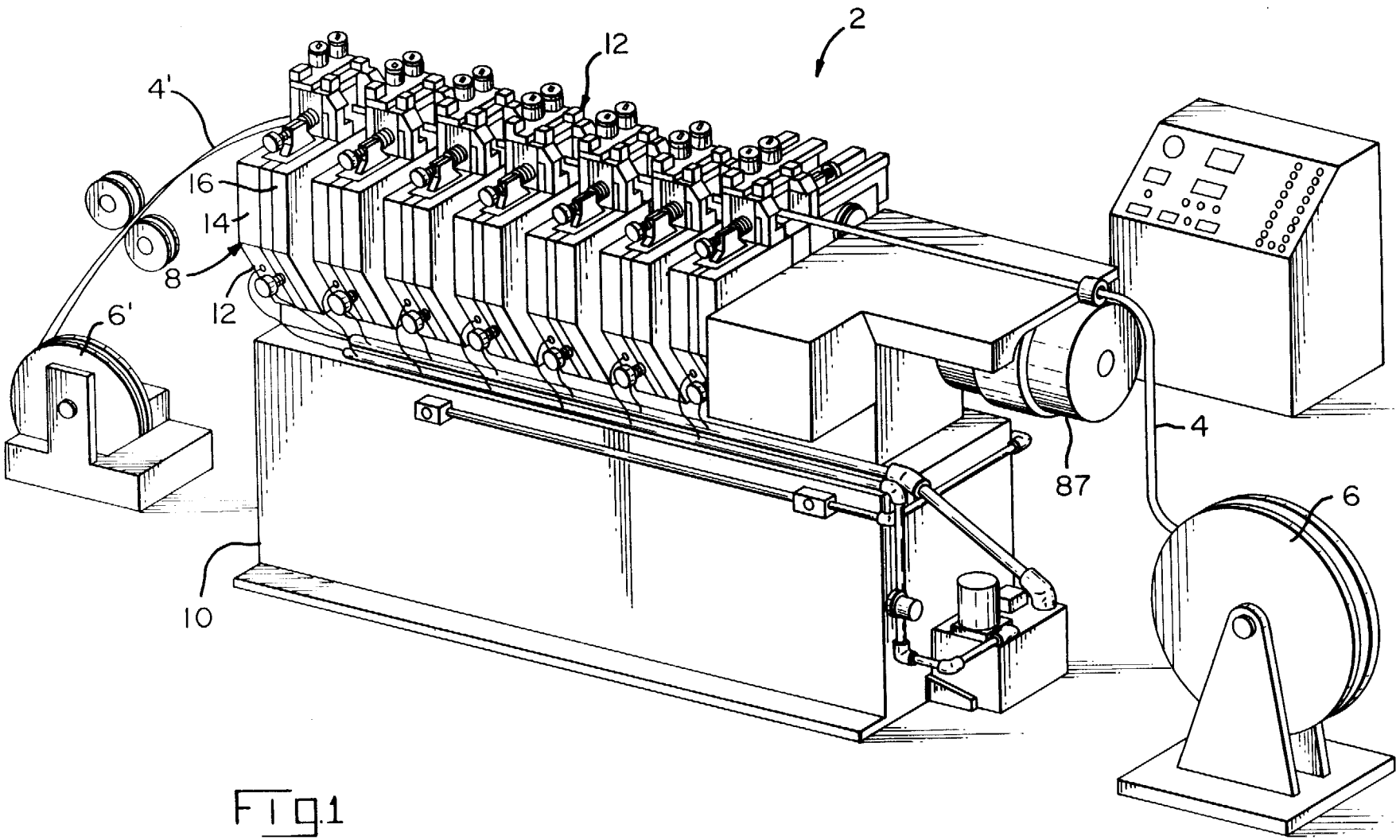
FIG. 1 is a perspective view of a machine in accordance with the invention which is composed of a plurality of machine modules mounted on a bed.
Figure 5:
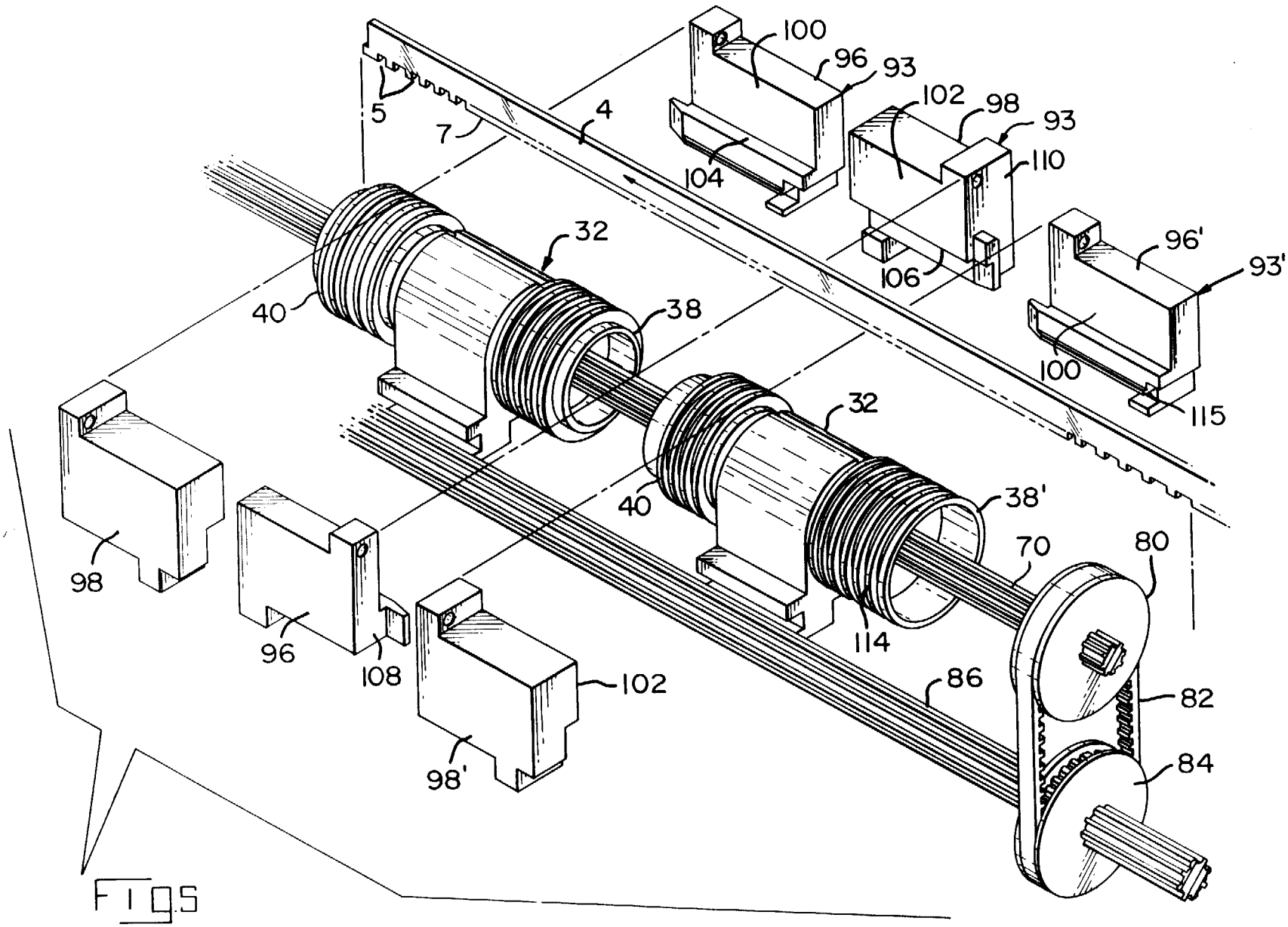
FIG. 5 is a semi-diagrammatic perspective view showing the strip feeders of two adjacent modules with the strip guides exploded from the strip feed path.
Figure 6:
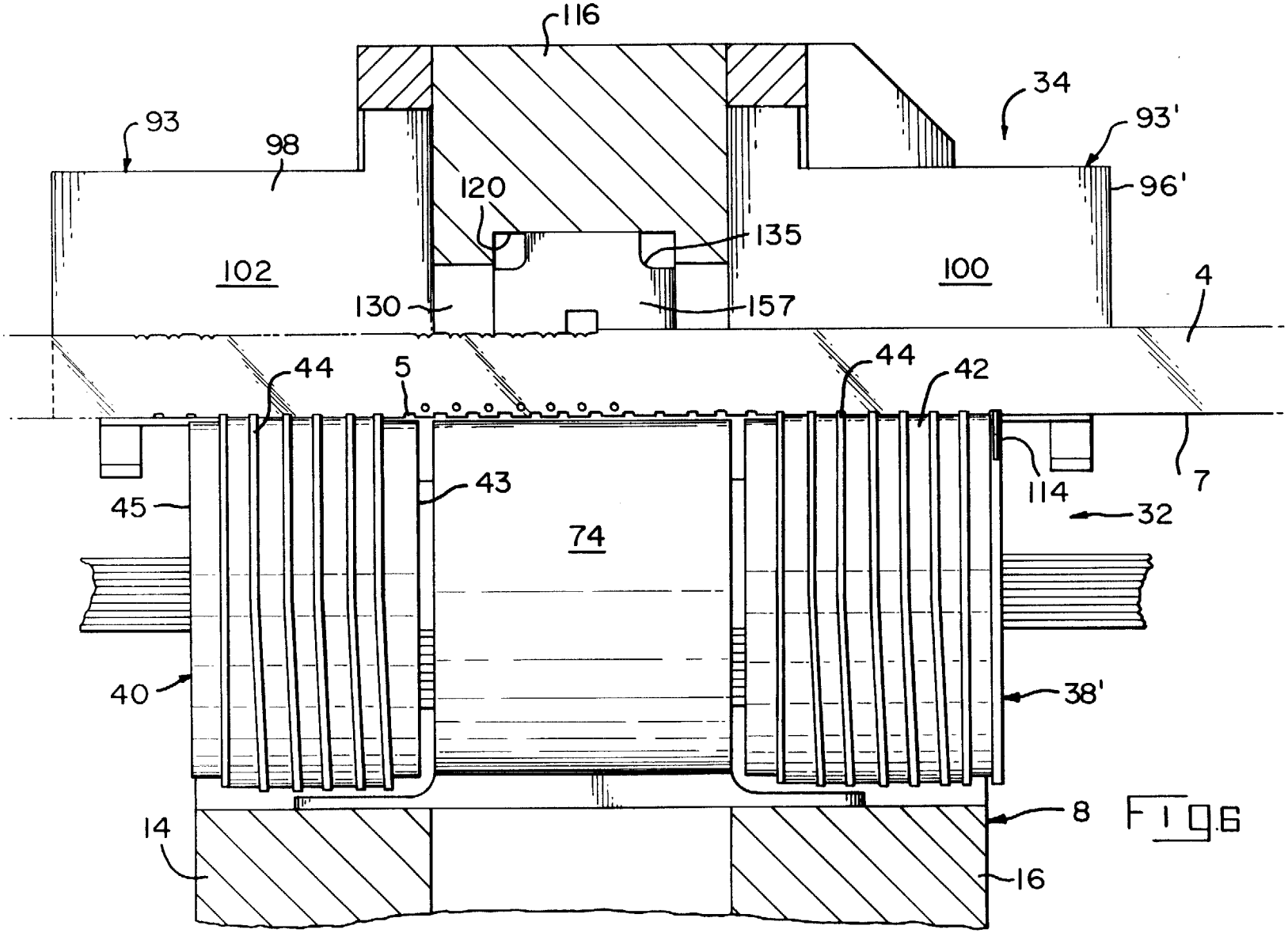
FIG. 6 is a view taken along the lines 6—6 of FIG. 2 and is a side view of a strip feeder.

Shaft 70 has a pulley 80 on its end, FIG. 5, which is coupled by a belt 82 to a pulley 84 on the main power shaft 86 which is continuously rotated during operation by a motor 87, FIG. 1. The main power shaft extends parallel to the feed shaft 70 and the axis of the two shafts define a vertical plane which extends symmetrically through the module as shown in FIG. 2.

The strip feeder is mounted in recess 37 between the opposed surfaces 90, 92 of the upper spacers 20, 22 and the upper portions of the housing sections. The mounting is achieved by means of linear adjustable bearings 94, FIG. 2, in a manner described in the above-identified application Ser. No. 444,291 to permit precise location of the strip during the dwell portion of each cycle as explained above.

Figure 10:
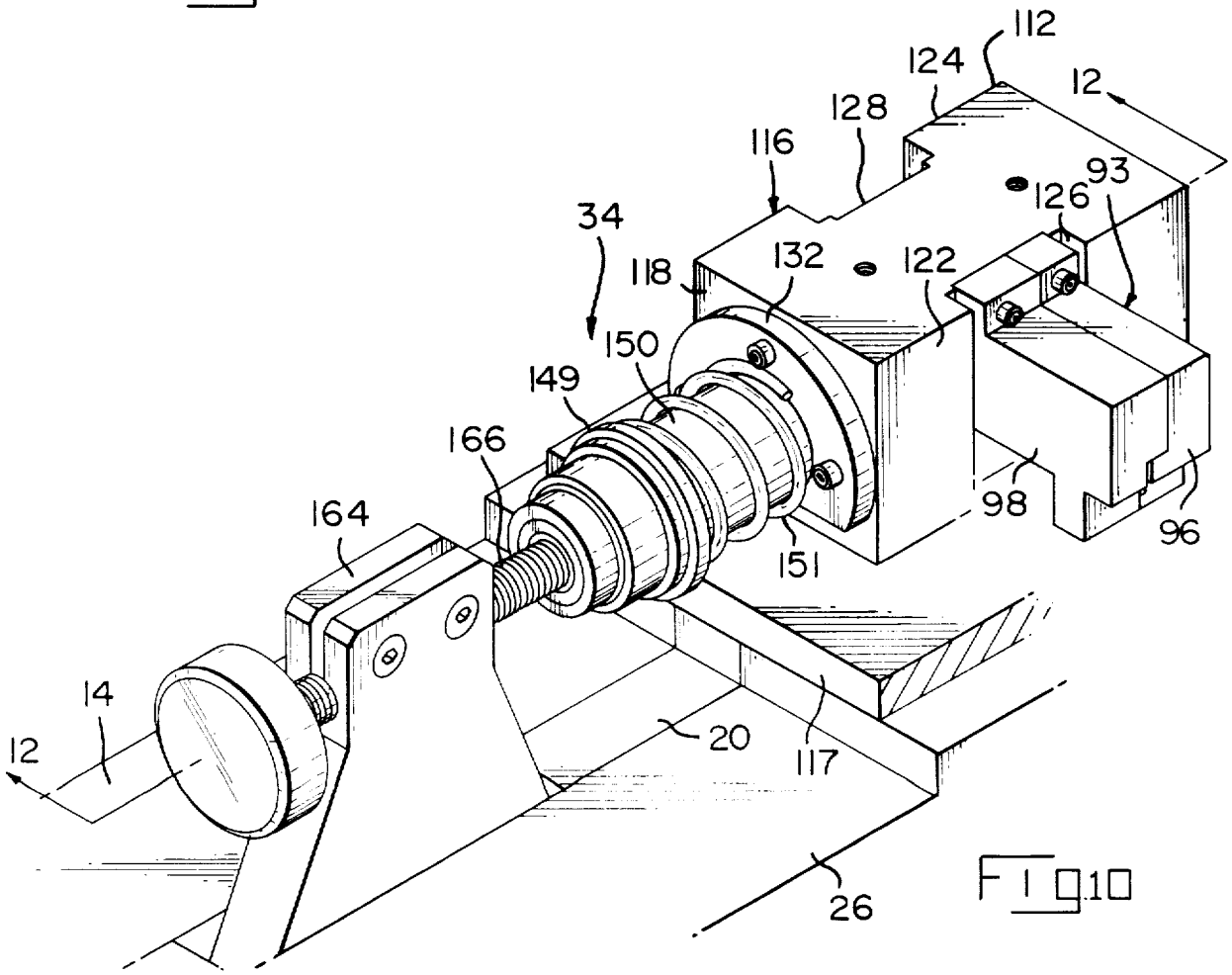
FIG. 10 is a perspective view of one side of the tooling assembly of one of the modules.

The strip 4 is guided along the strip feed path and through the modules by means of strip guide assemblies 93, FIG. 10, which are provided adjacent to each of the feed screws 38, 40. These guide assemblies each comprise a pair of complementary blocks 96, 98 having opposed surfaces 100, 102 respectively. The blocks are secured to each other by fasteners and the surface 100 of the block 96 has a ledge 104 which is received in a recess in the other block 98 when the two blocks are against each other. The block 98 has an overhanging ledge 106 on its surface 102 and the two ledges define a slot which guides the strip into, and from, the operating zone of the module; in other words, the zone in which the operation on the strip is carried out.

Figure 11:
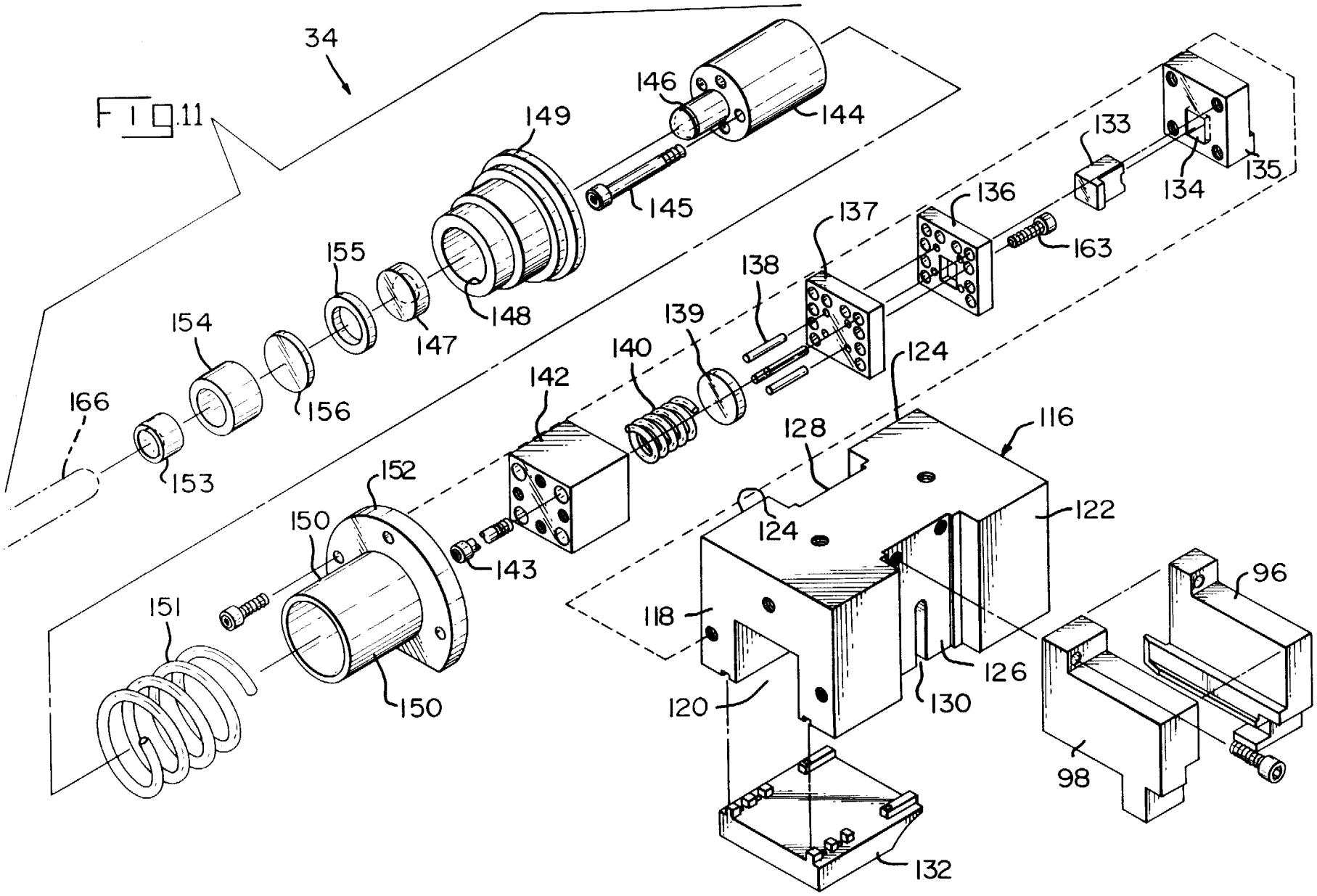
FIG. 11 is a perspective view of the tooling assembly of FIG. 10 with the parts exploded from each other.

As best shown by FIG. 5, the guide block assemblies 93 are identical to each other and the upstream guide for each strip feeder 32 has a block 98 on the left side of the strip feed path (as viewed in FIG. 5) and a block 96 on the right side of the strip feed path so that the ends 108, 110 of the blocks face leftwardly (downsteam) as viewed in FIG. 5. The downsteam guide assembly 93 associated with each strip feeder is adjacent to the feed screw 40 and it has a block 96 on the left-hand side of the strip feed path and a block 98 on the right-hand side of the path with the ends 108, 110 facing upstream. The blocks are secured against a tool holder guide block 116 which is shown in FIG. 11 and which is described below.

Figure 9:
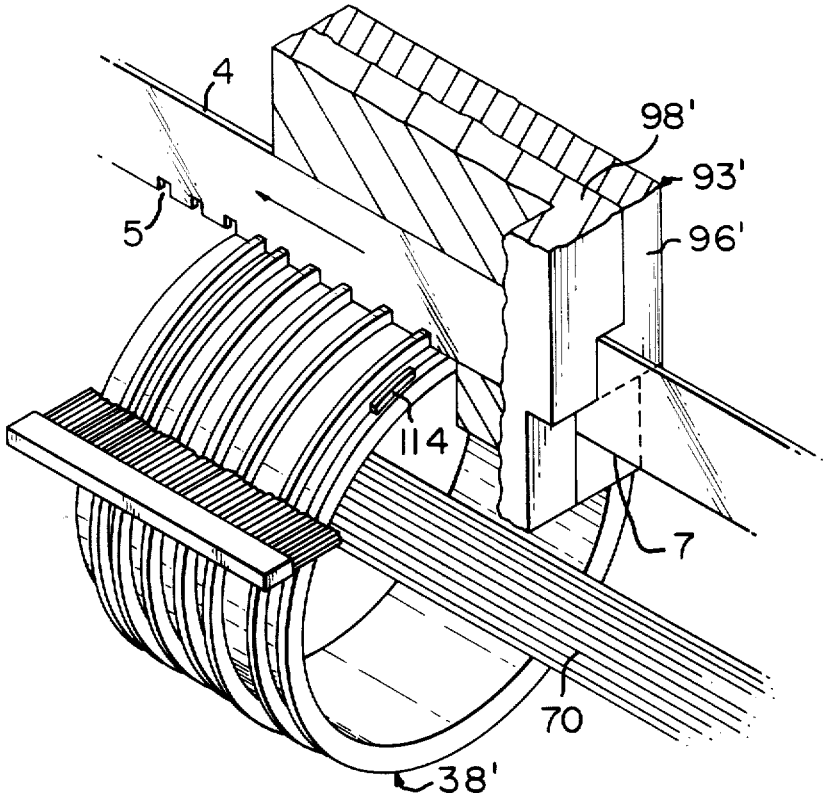
FIG. 9 is a fragmentary perspective view with parts broken away showing the first feed screw in the machine in which notches are punched in the lower edge of the strip being fed therethrough.

The strip 4 may be notched prior to its being fed into the machine, however, it is preferably to form the notches 5 in the first strip guide 93' shown in FIG. 5 by means of a notching punch 114 which is provided on the feed screw 38' adjacent to, but spaced from, the feed thread on the feed screw 38'. The notching punch 114 cooperates with a notching die 115 which is provided in the block 96' of the guide 93'. The remaining strip guides are identical to each other and do not have a notching die therein. Brushes may be provided as shown in FIG. 9 to remove the chips produced by the notching step.

It will be apparent from the foregoing description that during continuous rotation of the shaft 70, the strip will be moved through the machine by each of the strip feeders 32 on each of the modules. The notches will be formed by the upstream feed screw 38' in the first module and during each rotation of the shaft 70, the strip will dwell for a portion of the cycle. During the dwell portion, an operation is performed on the strip by the tooling assemblies which are described below.

Referring now to FIGS. 2 and 10–12, the tooling assemblies 34 on each side of the strip feed path have reciprocating parts which move towards each other and which are mounted in a guide block 116 that is mounted on plates 117 on the upper surface 26 of the housing assembly adjacent to the recess 37. The guide block 116 has laterally facing side surfaces 118 and a passageway 120 which extends between the surfaces 118 for the reciprocating tooling parts. Block 116 has an end surface 122 which faces upstream relative to the direction of strip movement and an end surface 124 which faces downstream. Recesses 126, 128 are provided in the surfaces 122, 124 for the strip guide assemblies 93. A strip guide slot 130 extends through block 116 between the surfaces 122, 124 and is in alignment with the guide slots or passageways in the guide assemblies 93. The lower surface of block 116 is covered by cover members 132 on each side of the slot 130, see FIG. 2.

The tooling assembly shown in FIG. 11 carries a forming tool 133 which is mounted or carried in a tool holder 136 and extends through an opening in plate 136 and the forward portion of the tool extends freely through an opening 134 in a stripper plate 135. A retaining plate 137 is disposed against the tool holder plate 136 and a plurality of pins 138 extend slideably through aligned openings in the plates 136, 137 and bear against the left-hand surface, as viewed in FIG. 12, of the stripper plate 135. At their other ends, pins 138 bear against a disc 139 which is slidably contained in a bore 141 in a slide block 142. A spring 140 is located between the disc 139 and the inner end of the bore 141. Screws 143 extend freely through the slide block 142, through the plate 137, through the tool holder 136, and are threaded into the stripper plate 135. As explained below, the stripper plate is movable relatively leftwardly from the position shown in FIG. 12 until it is against the tool holder plate 136 with accompanying compression of the spring 140. The stroke of the assembly shown in FIG. 12 is therefore partially represented by the gap 163 between the tool holder plate 136 and the stripper plate 135.

The slide block 142 is secured to a cylindrical slide 144 by means of screws 145 and the cylindrical slide has a projection 146 which bears against a bearing block 147 which is contained in a bore 148 in a coupling 149. Slide 144 is contained in a cylindrical guide 150 that has a flange 152 by means of which it is secured against the surface 118 of the block 116. A spring 151 surrounds the guide 150 and bears against the coupling 149 so that the coupling is biased leftwardly as viewed in FIG. 12 by this spring.

Motion is imparted to the reciprocating parts of the tooling assembly by a thrust screw 166 on the actuating mechanism described below. The screw 166 has a spherical end 167 that is received in a recessed thrust disc 153. The disc 153 is held in a spacer 154 in the bore 148 at the left-hand face of the coupling 149. A frangible disc 156 is provided, the disc 156 being beween the disc 153 and a ring 155 that has a reduced diameter opening 158. The frangible disc 156 is designed such that it will fracture in the event of a jam in the apparatus and permit movement of the thrust screw 166 without accompanying movement of the reciprocating parts and thereby avoid damage.

Figure 12:
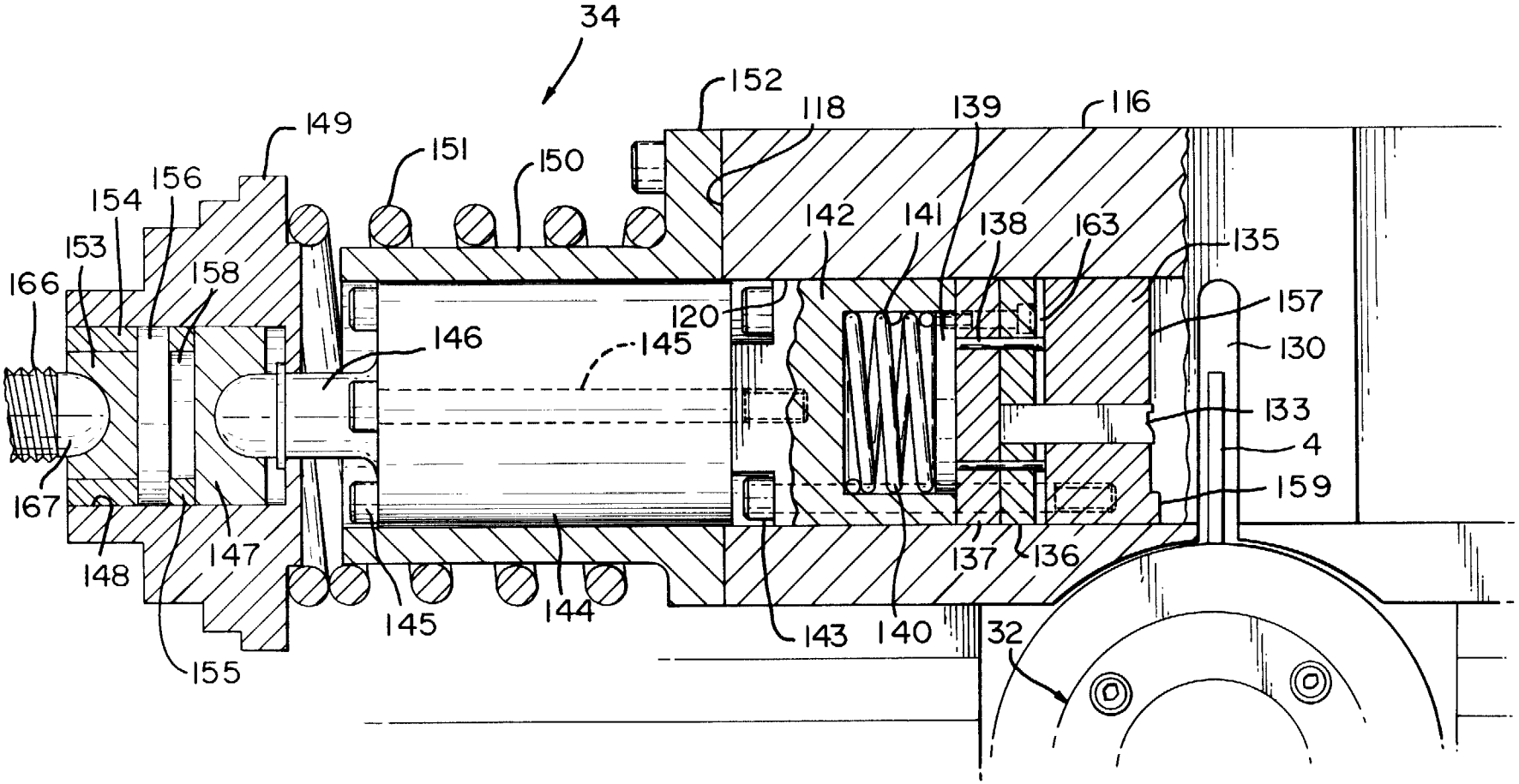
FIG. 12 is a view taken along the lines 12—12 of FIG. 10.

FIG. 12 shows the positions of the parts of the tooling assembly in its retracted position and during each operating cycle, these parts will move rightwardly until the strip is engaged by the tooling and the operation is performed. The tooling assembly on the right-hand side of the strip feed path will also move inwardly towards the strip in synchronism with the tooling shown in FIG. 12. During the operating cycle, the screw 166 will move rightwardly and thereby move all of the parts in the passageway 120 rightwardly until the face 157 of the stripper plate 135 moves into the slot 130 at which time a shoulder 159 on the stripper plate will be against the strip adjacent to its lower edge. The corresponding shoulder of the tooling assembly on the right-hand side of the operating zone will also be against the strip so that the strip will be pinched or held between two surfaces 159. Thereafter, the stripper plate 135 remains stationary and the slide 142 continues to move rightwardly so that the forming tool 133 is moved relatively to the stripper plate 135 and against the strip 4. When the gap 163 is at least partially closed, the inward stroke is completed and the screw 166 thereafter moves leftwardly. Initially, the slide 142 moves leftwardly during the return stack and thereafter the spring 140 returns the stripper plate 135 to the relative position shown in FIG. 12.

As previously mentioned, the stroke of the tooling assembly in FIG. 12 is quite small and is represented by the gap 163. However, the tooling assembly on the right-hand side of the center line will also have a stroke of about the same magnitude and the total stroke which is effectively available for the forming operation is the sum of the two.

Figure 4:
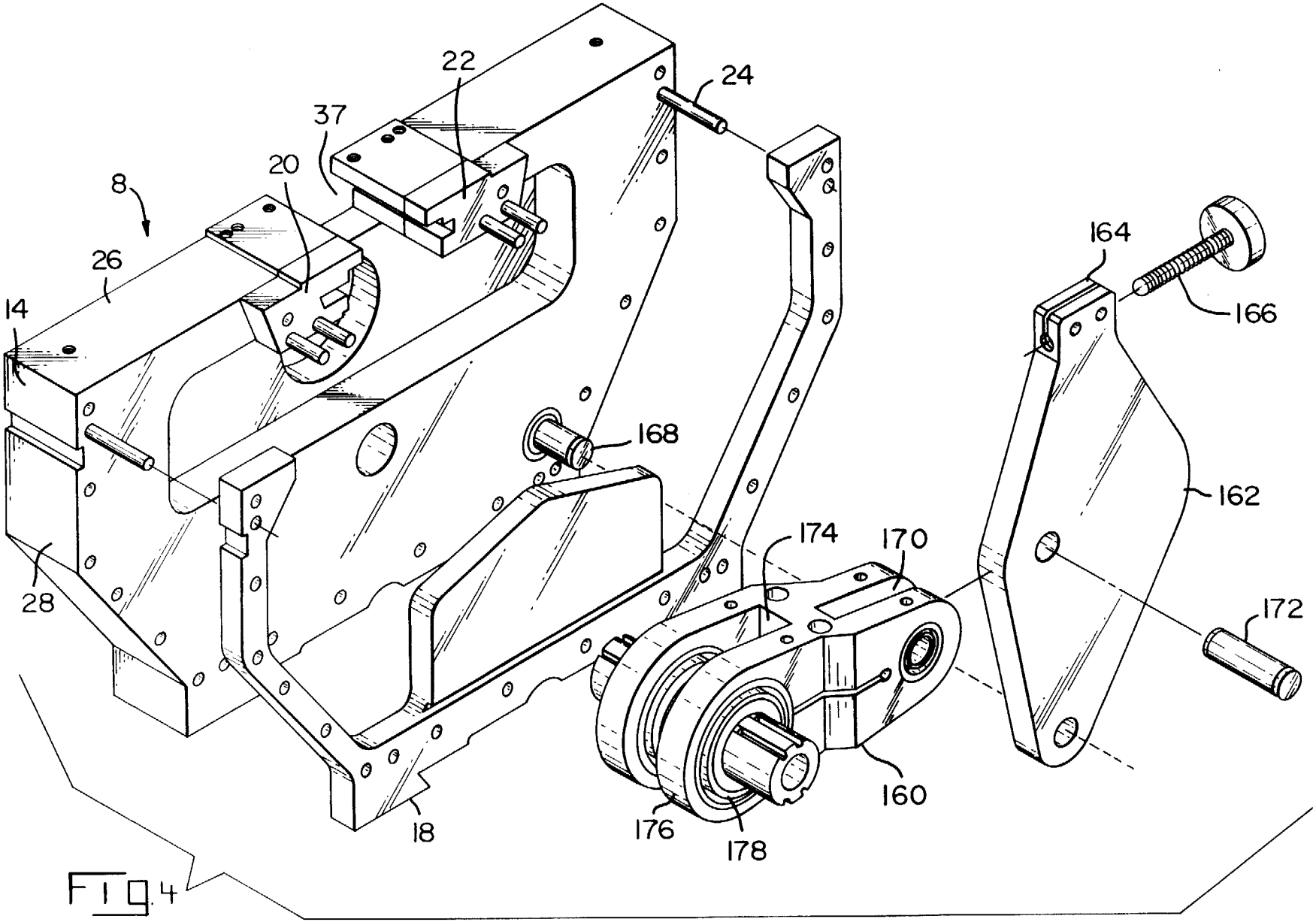
FIG. 4 is a view similar to FIG. 3 but showing the parts of only one of the actuating assemblies and showing the parts exploded from each other.

Referring now to FIGS. 2-4, the actuating assembly comprises the main power shaft 86, connecting links 160, and actuator levers 162. Each tooling assembly 34 has a connecting link and an actuator lever associated therewith.

The upper end 164 of the actuator lever 162 has the previously identified thrust screw 166 threaded therethrough. This screw can be adjusted to vary the limits of the stroke of the reciprocating parts. Each actuator lever 162 is pivoted at its lower end 168 and is pivoted intermediate its ends at 172 to its associated connecting link 160. As shown in FIG. 4, the connecting link is recessed as shown at 170 to receive the actuator lever and has a recess 174 at its inner end 176. The two connecting links 160 are identical to each other and can be mounted on the main power shaft 86 with the inner ends 176 overlapping each other as shown in FIG. 3. The inner ends of the connecting links are coupled to the main power shaft by eccentrics 178 which, during each complete rotation of the power shaft, move the connecting links in opposite directions away from and towards each other so that the actuator levers are oscillated in opposite directions towards and away from each other.

As previously mentioned, each module is symmetrical with respect to a plane which would be passed through the centers of the main power shaft 86 and the feed shaft 70. A plane extending through these shafts would also extend through the feed path of the strip as shown best at FIG. 2. For best results, and to achieve a high degree of dynamic balance in the apparatus, the two actuator levers should be of the same mass and moment of inertia, the two connecting links should be of the same mass and moment of inertia, and the parts of the tooling assembly on each side of the center line should be similarly balanced.

Figure 13:
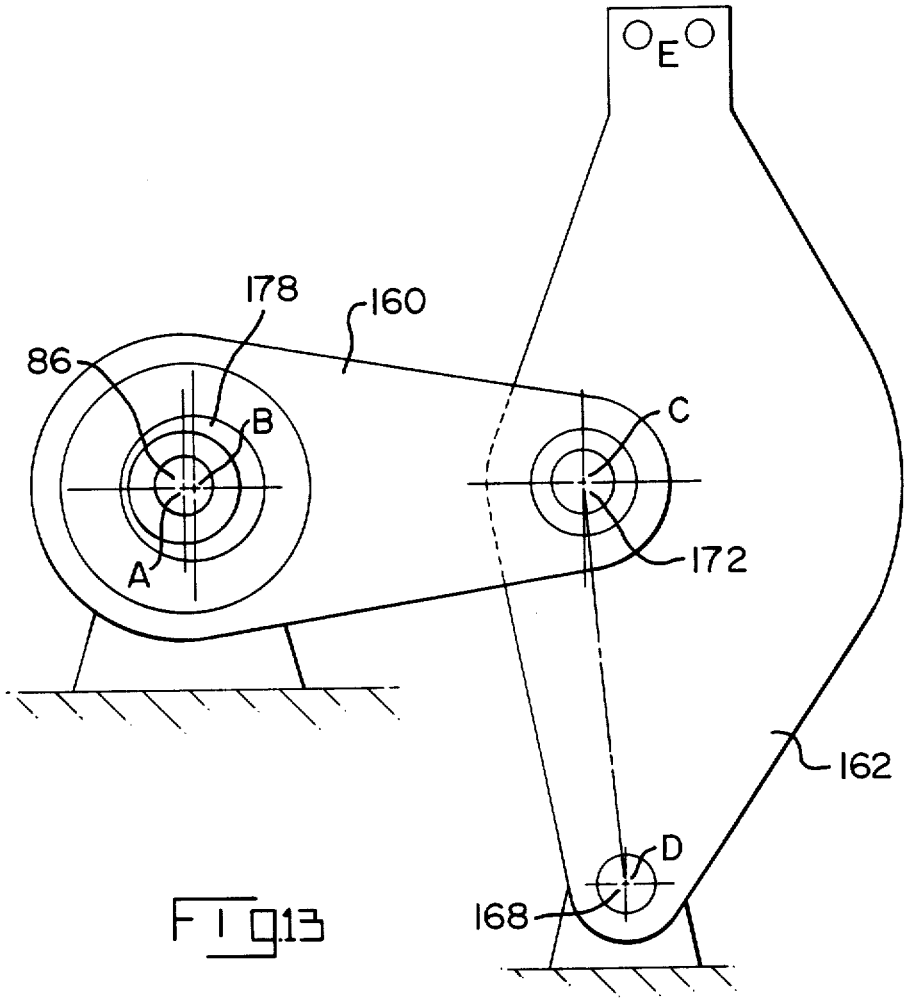
FIG. 13 is a semi-diagrammatic frontal view of the right-hand side of a module of the apparatus showing only the power shaft, the connecting link, and the actuator lever.
Figure 14:
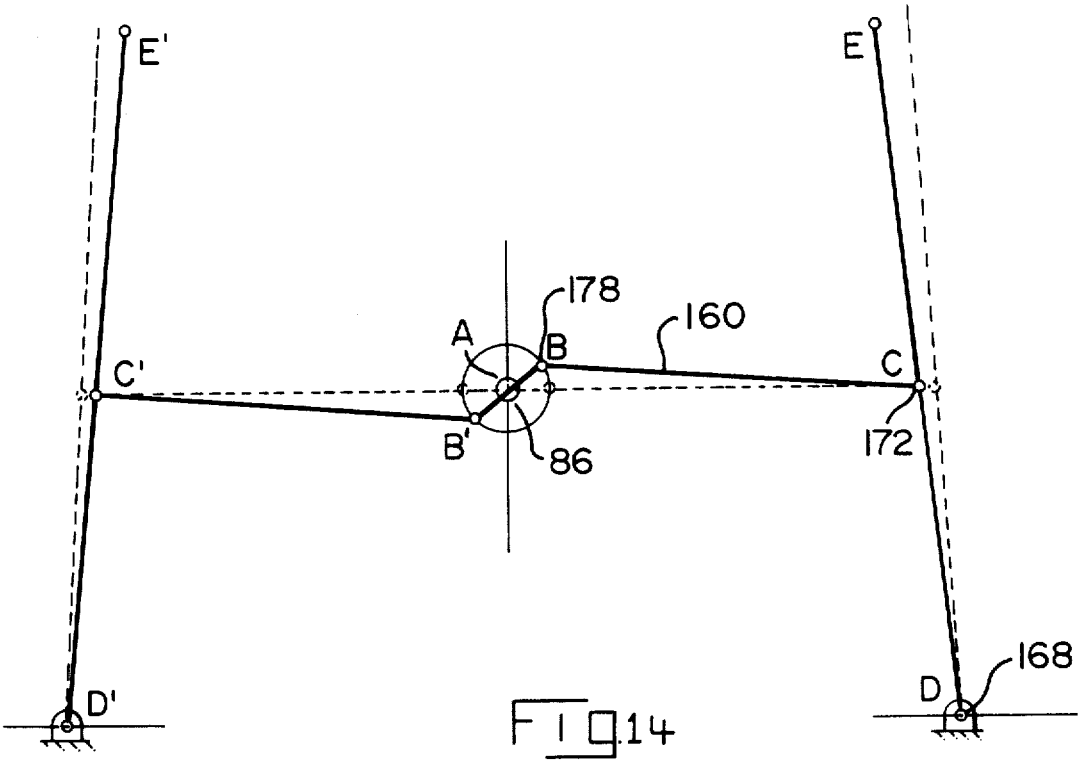
FIG. 14 is a diagrammatic representation of the actuator portion of the machine.

There are no strict dimensional limitations which must be observed in designing a machine in accordance with the invention, however, the individual modules should have a relatively small eccentricity in the eccentricity couplings 178 relative to the dimensions of the connecting links 160 and the actuating levers 162. A brief discussion is presented below of the dimensions of a particular machine in accordance with the invention with reference to FIGS. 13 and 14. In these figures, the locations of the pivot points and the eccentrics are indicated by letters A–E for convenience in the discussion and some features are exaggerated for purposes of illustration. Particularly, the eccentricities AB and AB' in FIG. 14 are greatly exaggerated.

One machine in accordance with the invention has modules which have an eccentricity AB, AB' of 0.0125 inches (0.318 mm) and has connecting links, AC, AC' which are 6.5 inches (165.1 mm) in length. The distance between the two pivotal axes 168, 172 of each of the actuator levers DC, DC' is 6.6 inches (167.6 mm) and the distance from the pivot point D to the tool loading point E is 13.2 inches (335.3 mm). The distance AD, AD' (the length of the base link) is about 9.3 inches (236 mm). A module 8 having these dimensions and having an eccentric as noted above has a stroke in each tooling block 135 of 0.05 inches (1.27 mm) so that the total stroke is actually 0.1 inches or 2.5 mm. This stroke is adequate for many profiling or similar operations which are carried out in the manufacture of sheet metal terminals. The eccentricity can be increased to 0.1 inches (2.5 mm) to produce a stroke in each tool block of 0.4 inches (10.2 mm) to yield a total stroke of 0.8 inches (20.4 mm). A module having these dimensions will develop a force of about 2,500 kg on the strip.

It can be seen from the foregoing discussion that a module 8 of a machine 2 in accordance with the invention is not massive when compared with conventional presses of the type which are commonly used for performing stamping and forming operations on sheet metal. The individual modules in the machine 2 can moreover have different strokes which would be tailored to the precise operation being carried out in each station.

As mentioned previously, a machine 2 in accordance with the invention has several advantages as compared with stamping and forming presses of the type currently in use. Some of the significant advantages are reduced power requirements coupled with the capability for operations at high speeds (2,000 to 3,000 or more strokes per minute), quietness in operation, reduced wear and therefore reduced maintenance on the tooling and moving parts of the machine. These advantages stem from several features of the invention which are discussed in general terms below.

As is mentioned above, each module has a relatively small eccentricity AB, AB' which is at most 2.5 mm and which, for many operations, will be as low as 1.27 mm. The base link length AD or AD' is, however, approximately 236 mm and the ratio of the eccentricity to the base link length AB/AD will always be an extremely low number, much less than unity. If for example, the eccentricity is 1.27 mm, the AB/AD ratio is approximately 0.005. This condition results in angular velocities and accelerations in the connecting links 160 and the actuator levers 162 which are nearly sinusoidal. Additionally, these velocities and accelerations are relatively low even when the machine is operated at high RPM. As a result, the inertial forces in the machine are minimized and the power requirements are thereby reduced. A further beneficial result is that the linear velocities and accelerations in the tooling blocks 135 are quite low relative to the rotational speed of the shaft 86 so that tool wear and wear on the moving parts of the tooling assemblies is minimized.

The wear of machine parts which move over each other is caused by abrasion and/or erosion. Abrasion wear is the type of wear caused by the mechanical abrading effect of the parts on each other while erosion results when the parts move at very high speeds and a high temperature is developed in an extremely narrow zone at the interface. Erosion wear can be explained in terms of contact physics as related to a phase change in the localized zone and removal of material while it is in the liquid phase. Erosion wear is greatly reduced or eliminated in a machine in accordance with the invention by virtue of the fact that the linear speeds of the parts, as compared with a conventional stamping press, are greatly reduced.

The very small eccentricities AB, AB' coupled with the dimensions of the connecting links 160 and the actuators levers 162 produce an extremely high mechanical advantage at the tool loading points E in FIG. 14. This feature again results in low torque requirements in the shaft 86 and therefore reduced power requirements for the machine as a whole.

Referring to FIG. 14, another important feature is that the angles BCD and B'C'D' are always relatively close to 90° (these angles being highly exaggerated in FIG. 14 for purposes of illustration). These angles BCD, B'C'D' are referred to as the power transmission angles in this type of mechanism and are important in the determination of the efficiency of the mechanism, particularly as regards the bearing loads developed during operation and the portion of the thrust in the connecting links which is transmitted to the tool loading points E, E'. It is recognized that the closer the transmission angles are to 90°, the smaller the vertical force component in the system and the greater the horizontal force component as viewed in FIG. 14. The horizontal force component is the useful component which is transmitted to the tool loading point E and is therefore available for performing work on the strip material being fed through the machine. The vertical force component, on the other hand, is in effect lost and must be contained by bearing members and static structural members in the machine. The fact that the transmission angles are always very close to 90° contributes to the low power requirements in that the power supplied to the shaft 86 is effectively utilized and also contributes to the fact that the structural components need not be designed to contain an excessive and useless vertical force component; in other words, this feature contributes to the compactness of the apparatus.

Another feature of the apparatus is that the connecting links 160 are placed in tension during application of the load to the strip material rather than in compression as in a conventional stamping press. The avoidance of compression loading in these members is advantageous in that tension loading is a much more efficient method of loading a machine element than compression loading. While most materials have very good compressive strengths, failure of machine parts as a result of compressive loads must be anticipated as a result of buckling rather than simple compressive failure of the metal. To avoid buckling, a part which is stressed in compression must be made relatively massive and bulky. The fact that the connection links are stressed in tension therefore permits them to be of smaller mass which in turn contributes to the lower power requirements of the apparatus.

Many of the features discussed above contribute to the relative quietness which characterizes a stamping machine in accordance with the invention. Much of the sound produced during operation of a conventional stamping press is a result of the impacting of the moving parts, particularly in the dies. In a conventional press, the linear speeds of the die parts are considerably higher, other things being equal, than are reached in a machine of the present invention designed in accordance with good design practice. The high linear speeds and the higher masses involved in conventional stamping machines result in a noise level which is often objectionable to the point of being an industrial hazard. A dramatic reduction in the noise level is achieved with the practice with present invention as a result of the lower masses of the parts and the lower linear speeds notwithstanding the relatively high operating speed of the machine in terms of revolutions per minute.

The foregoing discussion treats only briefly, and in a qualitative manner, some advantages of the invention. A more rigorous consideration of the operating principles will reveal further benefits.

We claim:

1. A machine module for performing operations on strip material, the machine module comprising a strip feeder for feeding the material intermittently along a strip feed path, an operating zone on the strip feed path, first and second tool holders in the operating zone, the tool holders being aligned with each other on opposite sides of the strip feed path and being movable towards and away from the strip feed path between retracted positions, in which the tool holders are spaced from the feed path, and closed positions, in which the tool holders are substantially against strip material on the strip feed path, and actuating means for actuating the strip feeder and for moving the tool holders between their retracted and closed positions in timed sequence with the strip feeder so that the tool holders are against the strip material during dwell of the strip, the machine being characterized in that:

the actuating means comprises a continuously rotatable power shaft, first and second actuator levers, and first and second connecting links, the power shaft extending parallel to, and being spaced from, the strip feed path, the actuator levers being on opposite sides of the strip feed path, the connecting links being eccentrically coupled to the power shaft and extending to the actuator levers, the actuating levers each having a force applying end and a pivoted end, the force applying ends being coupled to the tool holders, the pivoted ends being pivotally mounted on parallel pivotal axes which extend parallel to the main power shaft, and the conecting links being pivotally connected to the actuating levers at fixed locations intermediate the force applying and pivoted ends of the actuating levers.

2. A machine module as set forth in claim 1 characterized in that the actuator levers and the connecting links are contained in a housing having oppositely facing sidewalls, the power shaft extending through the housing and between the sidewalls.

3. A machine module as set forth in claim 1 characterized in that the actuator levers are in vertical planes, the connecting links extending horizontally to the power shaft.

4. A machine module as set forth in claim 3 characterized in that the actuator levers are co-planar, the actuator levers and the connecting links being symmetrical with respect to a vertical axis which extends through the power shaft.

5. A machine module as set forth in claim 4 characterized in that the first and second actuator levers are of substantially equal mass, the first and second connecting links are of substantially equal mass, and the first and second tool holders are of substantially equal mass.

6. A machine module as set forth in claim 5 characterized in that the module is adjustably mounted on a machine bed for movement parallel to the axis of the power shaft, the machine bed having at least one additional module adjustably mounted on, the additional module being similar to the original module, the power shaft and the strip feed path extending through the additional module.

7. A machine module as set forth in claim 6 characterized in that the housing has a top wall and oppositely facing endwalls which extend between the sidewalls, the tool holders being slidably mounted on the top wall, the actuator levers extending through openings in the top wall which are adjacent to the endwalls.

8. A machine module as set forth in claim 7 characterized in that the strip feeder is mounted in the top wall and is between the power shaft and the strip feed path.

9. A machine module as set forth in claim 1 characterized in that the module is symmetrical with respect to a plane of symmetry which is defined by the strip feed path and the axis of the power shaft.

10. A machine module as set forth in claim 9 characterized in that the actuator levers are of equal mass, the connecting links are of equal mass, and the tool holders are of equal mass, the module being substantially dynamically balanced during operation.

11. A machine module for performing operations on strip material, the machine module comprising a strip feeder for feeding the material intermittently along a strip feed path, an operating zone on the strip feed path, first and second tool holders in the operating zone, the tool holders being aligned with each other on opposite sides of the strip feed path and being movable towards and away from the strip feed path between retracted positions, in which the tool holders are spaced from the feed path, and closed positions, in which the tool holders are substantially against strip material on the strip feed path, and actuating means for actuating the strip feeder and for moving the tool holders between their retracted and closed positions in timed sequence with the strip feeder so that the tool holders are against the strip material during dwell of the strip, the machine being characterized in that:

the actuating means comprises a continuously rotatable power shaft, first and second co-planar actuator levers, and first and second connecting links, the power shaft extending parallel to, and being spaced from, the strip feed path, the actuator levers being on opposite sides of the strip feed path, the connecting links being eccentrically coupled to the power shaft and extending to the actuator levers, the actuating levers each having a force applying end and a pivoted end, the force applying ends being coupled to the tool holders, the pivoted ends being pivotally mounted on parallel pivotal axes which extend parallel to the main power shaft, the connecting links being pivotally connected to the actuating levers at fixed locations intermediate the force applying and pivoted ends of the actuating levers, the actuating levers and the connecting links being symmetrical with respect to the vertical axis which extends through the power shaft with the first and second actuator levers being a substantially equal mass, the first and second connecting links being a substantially equal mass, and the first and second tool holders also being a substantially equal mass.

* * * * *